United States Patent [19]

Tubbs

[11] Patent Number: 4,648,682

[45] Date of Patent: Mar. 10, 1987

[54] MODULAR ADAPTER AND CONNECTOR CABLE FOR VIDEO EQUIPMENT

[75] Inventor: Joseph T. Tubbs, Lynchburg, Va.

[73] Assignee: 501 Trans World Connections Ltd., Lynchburg, Va.

[21] Appl. No.: 743,707

[22] Filed: Jun. 11, 1985

[51] Int. Cl.[4] ..... H01R 13/50

[52] U.S. Cl. ..... 339/154 A; 339/177 R; 339/176 M

[58] Field of Search ..... 339/177 R, 177 E, 153, 339/154–157, 159 R, 164–166, 169, 176 M

[56] References Cited

U.S. PATENT DOCUMENTS

| | | | |
|---|---|---|---|
| 4,220,391 | 9/1980 | Krolak et al. | 339/176 M |
| 4,407,559 | 10/1983 | Meyer | 339/176 M |
| 4,447,106 | 5/1984 | Houtz et al. | 339/176 M |
| 4,472,010 | 9/1984 | Parnello | 339/176 M |
| 4,477,144 | 10/1984 | Huang | 339/177 R |

OTHER PUBLICATIONS

41 Fed. Reg., 28694–28707, (Jul. 12, 1976).

RCA SelectaVision Video Cassette Recorder VHS VJP 170 operating instructions, pp. 1 and 10–15 (1985).

Jasco Electronics, "Mr. Video, Your Complete 'How To' Home Video Guide", (no date).

*Primary Examiner*—Gil Weidenfeld

*Assistant Examiner*—David L. Pirlot

*Attorney, Agent, or Firm*—Mason, Fenwick & Lawrence

[57] ABSTRACT

Modular apparatus for connecting the UHF and VHF output terminals of a VCR to the UHF and VHF input terminals of a television or other video equipment, comprising first and second modular adapters and a modular connector cable. Each modular adapter comprises an insulated housing comprising a modular jack portion and either a coaxial connector portion or a twin-lead cable portion. A standard, six-position modular telephone jack is positioned in the modular jack portion. A male coaxial connector is positioned in the coaxial connector portion, while a 300 ohm twin-lead cable is positioned in the twin-lead cable portion. The conductors of the modular jack are electrically connected to the solid central conductor and the conductive wire sheath of the coaxial connector, or to the wires of the twin-lead cable. The modular connector cable comprises an insulated cable having first and second ends terminated respectively by first and second standard, six-position modular telephone connectors insertable into the modular jacks of the first and second adapters.

6 Claims, 14 Drawing Figures

FIG-6
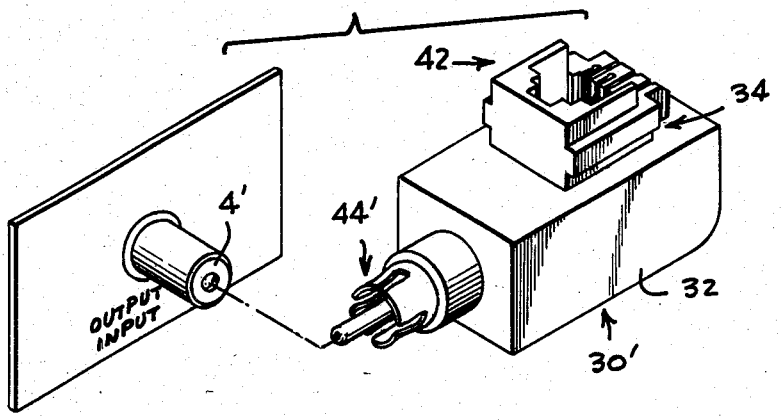
FIG-7
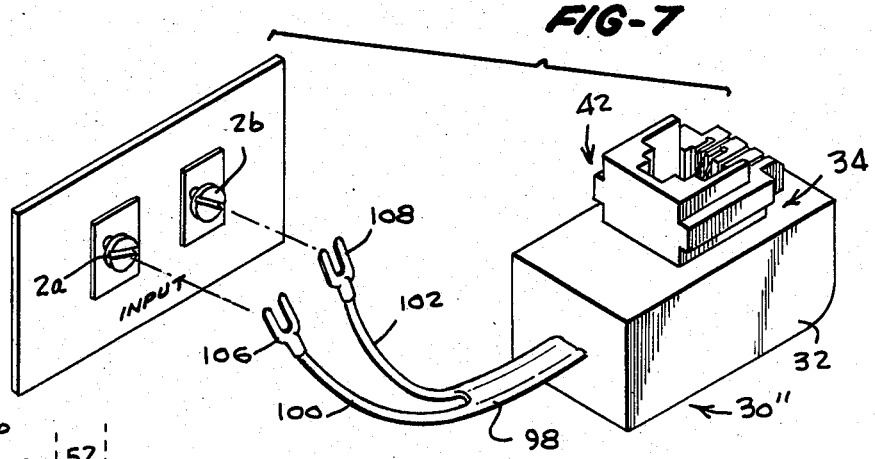
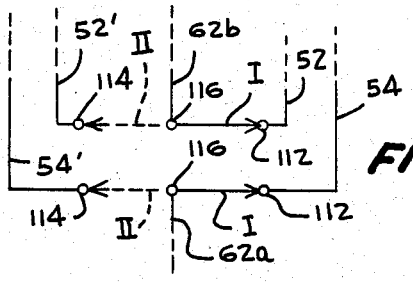
FIG-10
FIG-8
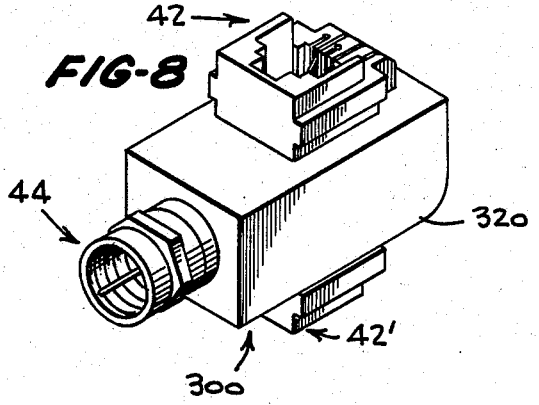
FIG-9
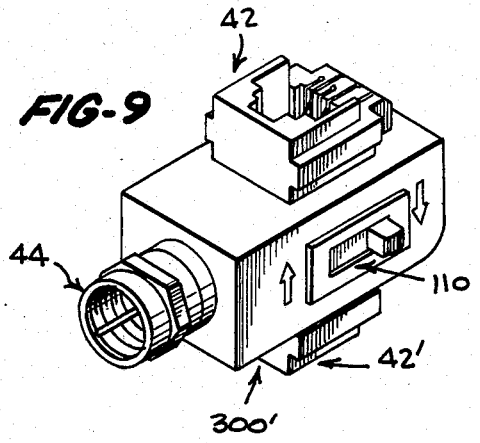

MODULAR ADAPTER AND CONNECTOR CABLE FOR VIDEO EQUIPMENT

BACKGROUND OF THE INVENTION

The present invention is directed to the field of adapters, and is more specifically directed to a modular adapter for use in combination with a modular connector cable in connecting a video cassette recorder (VCR) to a television, a computer monitor, or other video equipment.

As shown in FIGS. 1*a*, 1*b*, and 1*c*, a television 200 generally is provided with a pair of 300 ohm antenna screw terminals 2*a* and 2*b* for receiving UHF input and both a 75 ohm female RF coaxial antenna terminal 4 and a pair of 300 ohm antenna screw terminals 6*a* and 6*b* for receiving VHF input. There are three basic kinds of hook-ups between a television and an antenna, which depend upon the kind of antenna used, as shown in FIGS. 1*a*, 1*b*, and 1*c*. In the first kind, shown in FIG. 1*a*, an outside VHF antenna (not shown) is connected to the 75 ohm terminal 4 of the television with a 75 ohm (round) coaxial cable 8 and an outside UHF antenna (not shown) is connected to the 300 ohm UHF terminals 2*a* and 2*b* of the television with a 300 ohm (flat) twin-lead cable 10. In the second kind, shown in FIG. 1*b*, an outside VHF antenna or an inside VHF antenna (not shown) is connected to the 300 ohm VHF terminals 6*a* and 6*b* of the television with a 300 OHM (flat) twin-lead cable 12 and an outside UHF antenna is again connected to the 300 ohm UHF terminals 2*a* and 2*b* of the television with a 300 ohm (flat) twin-lead cable 10. In the third kind, shown in FIG. 1*c*, an outside UHF/VHF antenna (not shown) is connected to a signal splitter 14 connected to twin-lead cables 15*a* and 15*b* to provide UHF and VHF inputs from a 75 ohm (round) cable 16 to the 300 ohm terminals 2*a* and 2*b* and 6*a* and 6*b*, respectively.

Referring now to FIGS. 2*a*–2*c*, when a VCR 250 is used in conjunction with the television 200, the UHF and VHF antenna input must be fed to the television 200 through the VCR 250. For this purpose VCR's are provided with 75 ohm VHF female RF coaxial input and output terminals 18*a* and 18*b*, 300 ohm UHF input screw terminals 20*a* and 20*b* and output screw terminals 22*a* and 22*b*, and a 300 ohm to 75 ohm VHF antenna adapter 24 (shown in FIGS. 2*b* and 2*c*).

At present, as shown in FIGS. 2*a*–2*c*, a 75 ohm RG 59 (round) coaxial connector cable 26 terminated at its ends by two male RF coaxial connectors 26*a* and 26*b* of the F-connector type is used between the VHF output terminal 18*b* of the VCR and the 75 ohm VHF antenna terminal 4 or the 300 ohm VHF terminals 6*a* and 6*b* of the television, while a 300 ohm (flat) twin-lead connector cable 27 is used between the UHF output terminals 22*a* and 22*b* of the VCR and the UHF antennas 2*a* and 2*b* of the television. In addition, when the VHF antenna uses a 300 ohm twin-lead cable 12, as shown in FIG. 2*b*, or a signal splitter 14, as shown in FIG. 2*c*, a 75 ohm to 300 ohm VHF matching transformer 29 having a twin-lead connector 29*a* must be used between the RG 59 connector cable 26 and the VHF terminals 6*a* and 6*b* of the television.

The RG 59 connector cable is an expensive and very bulky means of connecting the VCR to the television. It also creates a nest of wires behind the VCR and the television, which at best is unattractive, and at worst poses a safety hazzard.

There are also situations when it may be desirable to hook up a VCR to other video equipment, for example a computer monitor or a video amplifer. Such hook-ups require additional cables and connectors not generally provided by VCR manufacturers with the purchase of a VCR. Such cables and connectors as are available to the consumer in the electronic after-market are as expensive and bulky as the connector cables provided with the VCR, and only add to the nest of wires already running between the VCR and the television.

Also, there may be situations when it would be desirable to view the VCR output on a television or monitor other than the one to which the VCR is directlyC connected. Presently, in order to accomplish this, it is necessary to feed the VCR output signal into a multiple output signal splitter, either alone or in combination with a video amplifier, and run connector cables from the signal splitter to those televisions where the output is desired to be seen. If the second television or monitor is in another room this may require running connector cables between several rooms, which is both expensive and a safety hazzard. Also, it becomes very impractical to connect a VCR and a television which are on different floors. It is the solution of these and other problems to which the present invention is directed.

SUMMARY OF THE INVENTION

Therefore, it is a primary object of this invention to provide a modular adapter for use in combination with a modular connector cable which can replace the original equipment connector cable between a VCR and a television.

It is another object of this invention to provide a modular adapter for use in combination with a modular connector cable which can connect a VCR to a computer monitor.

It is another object of this invention to provide a modular adapter for use in combination with a modular connector cable which can connect a VCR to a video amplifier.

It is still another object of this invention to provide a modular adapter for use in connection with a modular connector cable which can connect a VCR to a television in another room using the building telephone wiring.

It is still another object of this invention to provide a modular adapter for use in combination with a modular connector cable which can easily connect and disconnect a VCR to and from other video equipment.

These and other objects of this invention are achieved by the provision of a modular adapter comprising an insulated housing and a standard, six-position modular telephone jack and a male coaxial connector positioned in the housing. The modular telephone jack has at least two conductors mounted therein in two of the six positions. Two of these conductors are electrically connected to the solid center conductor and the conductive tubular wire shield of the male RF coaxial connector.

A modular connector cable is provided comprising an insulated cable having at least two insulated wires therein terminated at either end by a standard six-position modular telephone plug. Each modular plug has first and second conductive terminals contained therein piercing first and second wires respectively of the cable. The conductive terminals are positioned in two of the six positions of the modular plug corresponding to the positions in which the first and second conductors are mounted in the modular telephone jack. In one aspect of the invention, the conductors of the modular jack and the conductive terminals of the modular plugs are positioned in positions two and five of the modular jack and the modular plugs, so that the modular plugs can be plugged into the modular jacks of a building's telephone wiring without intefering with the telephone system.

In another aspect of the invention, the modular adapter comprises a housing and a standard six-position modular telephone jack and a 300 ohm twin-lead cable positioned therein.

In still another aspect of the invention; the modular adapter comprises a housing, and two standard six-position modular telephone jacks and a male RF coaxial connector positioned in the housing. A two pole slide switch can also be positioned in the housing to select between the jacks.

A better understanding of the disclosed embodiment of the invention will be achieved when the accompanying detailed description is considered in conjunction with the appended drawings, in which like reference numerials are used for the same parts as illustrated in the different figures.

BRIEF DESCRIPTION OF THE DRAWINGS

FIG. 6 is an exploded perspective view of another embodiment of a VHF adapter according to the invention, in use with a phono input/output terminal;

FIG. 7 is an exploded perspective view of a UHF adapter according to the invention in use with a 300 ohm UHF terminal;

FIG. 8 is a perspective view of a third embodiment of a VHF adapter;

FIG. 9 is a perspective view of a fourth embodiment of a VHF adapter; and

FIG. 10 is a partial circuit diagram of the VHF adapter of FIG. 9.

DESCRIPTION OF THE PREFERRED EMBODIMENTS

Figure 3:
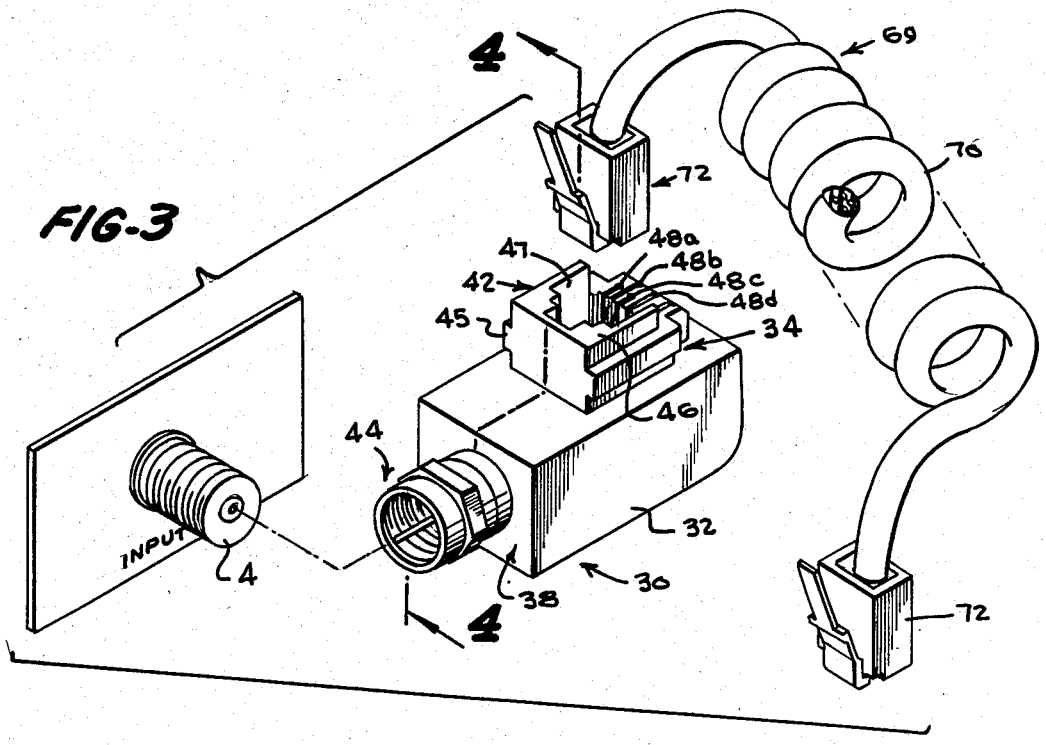
FIG. 3 is an exploded perspective view of a VHF adapter and connector cable according to the invention in use with a 75 ohm VHF input terminal.
Figure 5:
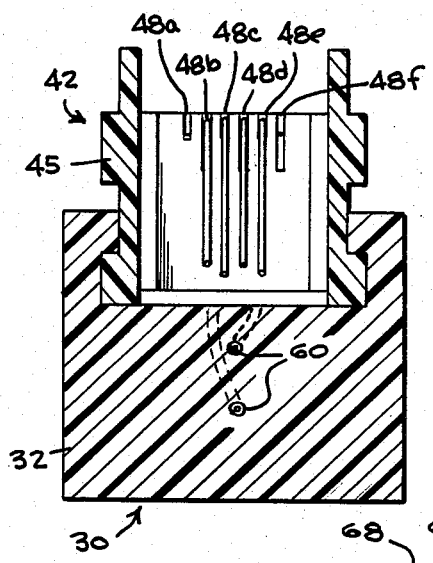
FIG. 5 is a cross-sectional view of the adapter of FIG. 3, taken alaong line 5—5 of FIG. 4.
Figure 4:
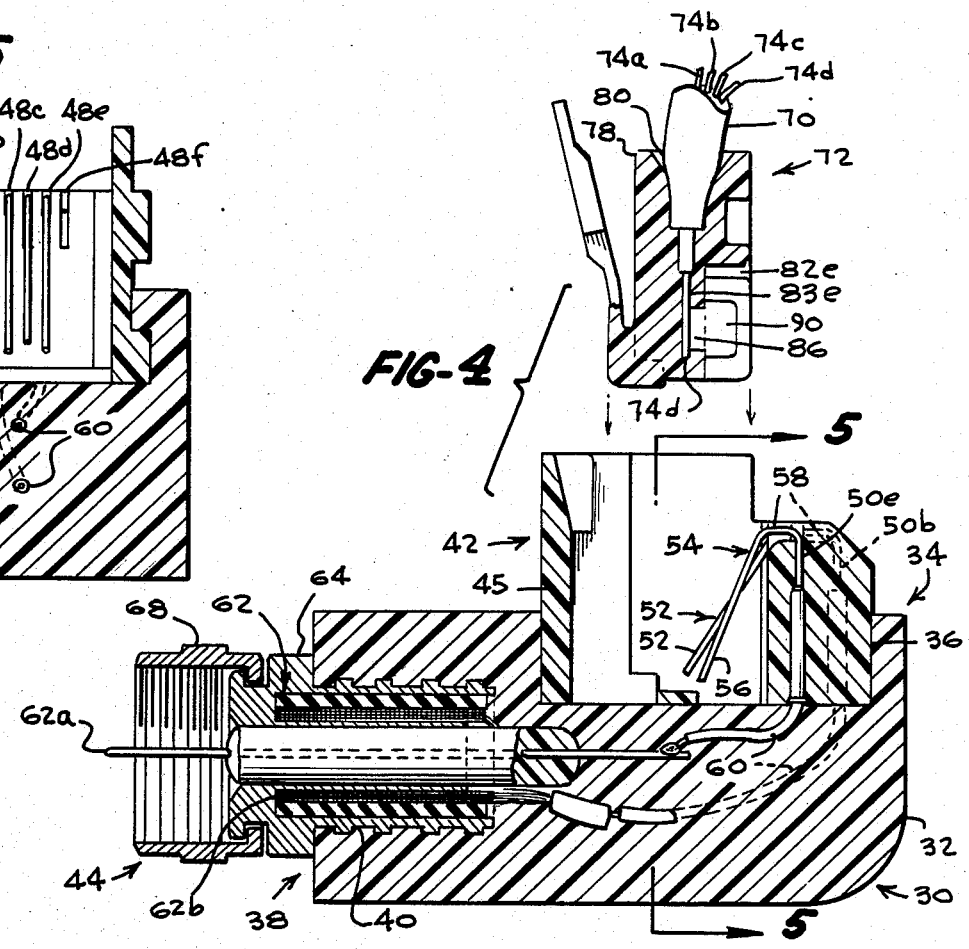
FIG. 4 is a cross-sectional view of the adapter and connector cable of FIG. 3, taken along line 4—4 of FIG. 3.

Referring now to FIGS. 3–5, there is shown a preferred embodiment of the invention, in which the reference numeral 30 refers to a VHF modular adapter. VHF adapter 30 comprises a moulded, insulated housing 32 having a modular jack portion 34, a modular jack-receiving opening 36 extending into modular jack portion 34, a coaxial connector portion 38, and a coaxial connector-receiving opening 40 extending into coaxial connector portion 38. A standard, six-position modular telephone connector or jack 42 of the kind described in 41 Fed. Reg. 28694-28707 (July 12, 1976) is positioned in modular jack-receiving opening 36. An RF coaxial connector 44 of the F-connector type is positioned in coaxial connector-receiving opening 40. Preferably, housing 32 is made from PVC, and is moulded around modular jack 42 and RF coaxial connector 44.

Modular jack 42 comprises an insulated housing 45 having a plug-receiving portion 46, and a modular plug-receiving opening 47 extending into plug-receiving portion 46. First, second, third, fourth, fifth, and sixth spaced-apart recesses 48*a*, 48*b*, 48*c*, 48*d*, 48*e*, and 48*f* are provided in plug-receiving opening 47, which communicate with first-sixth channels (only second and fifth channels 50*b* and 50*e* are shown) respectively. Positions 1–6 of modular jack 42 correspond to the locations of recesses 48*a*–48*f*, respectively, and the first-sixth channels respectively. The first-sixth channels extend through jack housing 45 and communicate with modular jack-receiving opening 36.

First and second stamped and formed conductors 52 and 54 are mounted in jack housing 45 in parallel, spaced-apart relation in positions 2 and 5. Each conductor has a contact spring portion 56 which extends diagonally from plug receiving portion 46 into plug-receiving opening 47, an intermediate portion 58 reversibly bent at recesses 48*b* and 48*e* in plug-receiving portion 47 extending through channels 50*b* and 50*e*, respectively, and an insulated end portion 60 extending out of channels 50*b* and 50*e* into adapter housing 32. In a preferred embodiment of the invention, a Hirose model number TNIR-623K66SE-150 modular jack is used. It should be understood that although only two conductors 52 and 54 are shown, jack 42 can include up to six conductors. However, as only two conductors are needed, it is more economical to use only two.

Figure 1A:
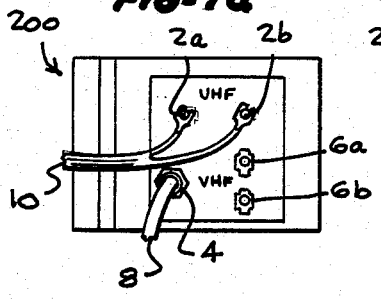
FIG. 1*a* is a partial, rear elevational view of a first hook-up between a television and a UHF and VHF antennas.
Figure 1B:
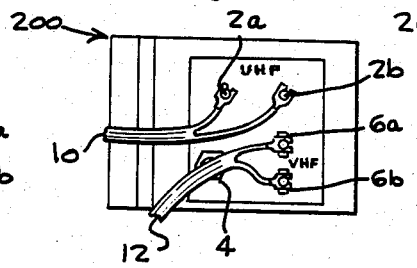
FIG. 1*b* is a partial, rear elevational view of a second hook-up between a television and UHF and VHF antennas.
Figure 1C:
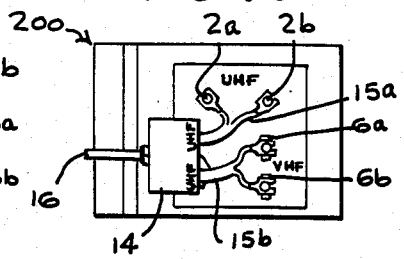
FIG. 1*c* is a partial, rear elevational view of a third hook-up between a television and a UHV/VHF antenna.
Figure 2A:
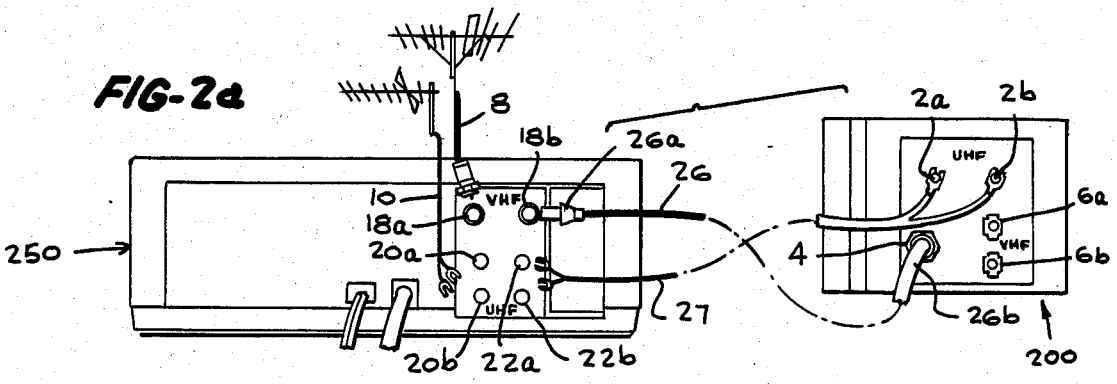
FIG. 2*a* is a rear elevational view of a first hook-up between UHF and VHF antennas, a VCR, and a television.
Figure 2B:
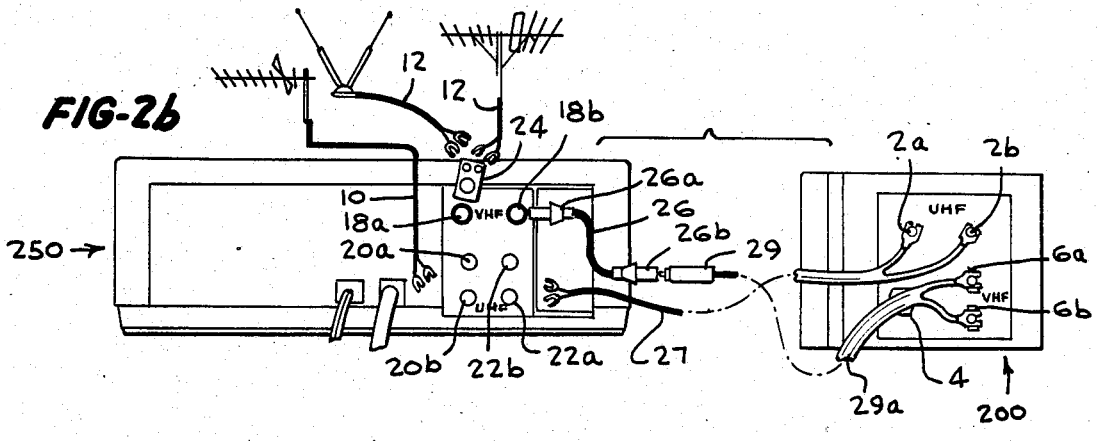
FIG. 2*b* is a rear elevational view of a second hook-up between UHF and VHF antennas a VCR, and a television.
Figure 2C:
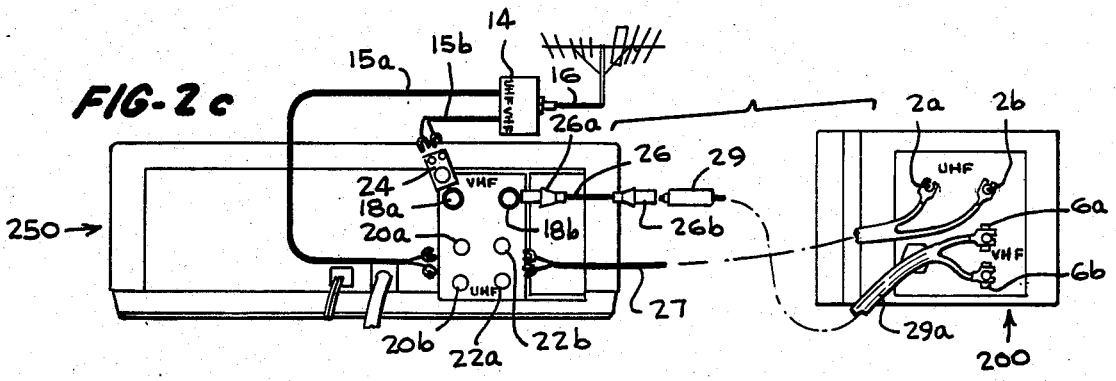
FIG. 2*c* is a rear elevational view of a third hook-up between a UHF/VHF antenna, a VCR, and a television.

RF coaxial connector 44 is similar to the RF coaxial connectors 26*a* and 26*b* (FIGS. 2*a*–2*c*) used to terminate an RG 59 coaxial cable for mating with the 75 ohm antenna terminal for a television or the VHF input and output terminals 18*a* and 18*b* of a VCR. RF coaxial connector 44 comprises a length of RG 59 coaxial cable 62 positioned in a metal housing 64, a portion of the solid central conductor 62*a* of the coaxial cable 62 extending outside the housing 64. A rotatable, internally threaded nut 68 is attached to housing 64 around central conductor 62*a* for securing connector 44 to terminals 4 or 18*b*. Alternatively, a snap collar (not shown) can be used in place of threaded nut 68 to secure F-connector 44 to terminals 4 or 18*b*. Central conductor 62*a* and conductive wire sheath 62*b* of coaxial cable 62 are electrically connected, for example by soldering, to the end portions 60 of conductors 52 and 54, respectively, of modular jack 42.

A modular adapter 30 as shown in FIG. 3 is used in pairs. One adapter 30 is coupled directly to the 75 ohm VHF antenna terminal 4 of the television, or if necessary, can be coupled to a 300 ohm to 75 ohm adapter box (matching transformer) (not shown), which is connected to the 300 ohm terminals (not shown) of the television. The other adapter 30 is connected directly to the 75 ohm VHF output terminal (not shown) of the VCR.

The two adapters 30 are electrically connected to each other by a connector cable 69 comprising an insulated cable 70 terminated at both ends by a standard, six-position modular telephone plug 72 of the kind described in 41 Fed. Reg. 28694-28707 (July 12, 1976). Insulated cable 70 has four parallel, spacedapart insulated wires 74*a*–74*d* therein. Wires 74*a* and 74*d* are on the outside, and wires 74*b* and 74*c* are in the middle. Preferably, cable 70 is coiled, to provide maximum length in minimum space. However, standard four-wire flat telephone cable or the like can also be used.

Referring now to FIG. 4, modular telephone plug 72 comprises an insulated housing 78 having a cable-receiving opening 80 therein which receives an end of insulated cable 70. Cable-receiving opening 80 communicates with first-sixth recesses (only fifth recess 82*e* is shown), corresponding to positions 1–6 of modular telephone plug 72 and positions 1–6 of modular jack 42, by means of first-sixth channels (only fifth channel 83*e* is shown).

Outside wires 74*a* and 74*d* of insulated cable 70 are connected by first and second insulation piercing tangs (only second tang 86 is shown) to first and second conductive blade-like terminals (only second terminal 90 is shown) contained in the second and fifth recesses, respectively. When modular telephone plug 72 is inserted into the plug-receiving opening 47 of modular jack 42, the tops of the first and second terminals engage the surfaces of spring contact portions 56 of conductors 52 and 54, respectively, in second and fifth recesses 48*b* and 48*e* in modular jack 42.

Referring now to FIG. 6, there is shown a modular monitor adapter 30′ for use in connecting a VCR to a computer monitor. Adapter 30′ is for the same adapter 30, except that it utilizes an AF coaxial connector 44′ of the phono plug type adapted to mate with the input terminal 4′ of a computer monitor. A modular adapter 30′ is generally used in conjunction with a modular adapter 30 coupled to the VCR and a connector cable 69 connecting adapters 30 and 30′. In this way, the VCR output can be trasmitted to a computer monitor.

Referring now to FIG. 7, there is shown a modular UHF adapter 30″ for use in connecting the UHF output terminals of a VCR to the UHF input terminals 2*a* and 2*b* of a television. UHF adapter 30″ is the same as modular VHF adapter 30, except that it utilizes a 300 ohm twin-lead cable 98 adapted to mate with 300 ohm UHF terminals. Twin-lead cable 98 is of a standard, commercially available variety, and comprises a pair of parallel, spaced-apart insulated conductive wires 100 and 102 terminated at one end by spade lugs 106 and 108, respectively. Wires 100 and 102 at their other end are electrically connected, for example by soldering, to the end portions 60 of conductors 52 and 54 of modular jack 42.

It should be noted that several variations of adapters 30, 30′ and 30″ are possible. Referring now to FIG. 8, there is shown an adapter 300 similar to adapter 30, but having an additional output. Adapter 300 comprises a moulded insulated housing 320 having first and second modular jack portions 34 and 34′ having opposed first and second six-position modular jack 42 and 42′ therein and a coaxial connector portion 38, having an F-connector 44 therein. Modular jack 42′ is identical to modular jack 42, and is electrically connected to central conductor 62*a* and conductive wire sheath 62*b* of connector 64 in the same manner as modular jack 42.

Referring now to FIGS. 9 and 10, there is shown an adapter 300′ similar to adapter 300, but having a double pole double throw slide switch 110 mounted therein to enable selection between first and second modular jacks 42 and 42′. Switch 110 is of standard configuration and is movable between first and second positions I and II. It includes first and second pairs of end terminals 112 and 114 corresponding to first and second positions I and II, respectively, of switch 110, and a third center pair of terminals 116. First and second pairs of end terminals 112 and 114 are electrically connected, e.g. by soldering, to conductors 52 and 54 of modular jack 42 and to conductors 52′ and 54′ of modular jack 42′, respectively. The third pair of terminals 116 is connected to central conductor 62*a* and conductive wire sheath 62*b*. Thus, when switch 110 is in first position I, coaxial connector 44 is connected to modular jack 42, and when switch 110 is in second position II, coaxial connector 44 is connected to modular jack 42′.

A modular adapter 300 or 300′ is used to transmit the VCR output to two different devices, e.g., to two televisions, to a television and a computer monitor, etc. The F-connector 44 of adapter 300 or 300′ is coupled directed to the 75 ohm VHF output terminal 18*b* of the VCR. The appropriate modular adapter 30 or 30′ is coupled to the 75 ohm VHF antenna terminal 4 of a television or the input terminal of a computer monitor, respectively. The adapter 300 or 300′ is then electrically connected to each of the modular adapters 30 or 30′ by a connector cable 70.

If it is desired to receive the output of a VCR in a first room on a television or a monitor in a second, third, or other room, the modular adapters of the invention can be used with modular connector cables 69 to transmit the VCR output through the building telephone system. This is accomplished by connecting an adapter 30, 300, or 300′ to the VHF output 18*b* of the VCR, connecting one end of a first connector cable 69 to adapter 30, 30′, 300, or 300′ and plugging the other end of first connector cable 69 into the room modular telephone jack. In the other room, an adapter 30 or 30′ is plugged into the appropriate terminal of the receiving television or monitor, and the adapter 30 or 30′ is connected to the second or other room modular telephone jack using a second connector cable 69. There will be no interference with the building telephone system because most home telephone systems use only positions 3 and 4 of the modular plug and jack to transmit signals, while all the adaptors 30, 30′, and 30″, 300, and 300′ of the invention and modular plug 72 use positions 2 and 5. The use of the present invention to transmit VCR output to video devices located in different rooms thus is limited only by the location of the home telephone system modular telephone jacks.

When the home telephone system is used to transmit the VCR output, it may be necessary to use a video amplifier to amplify a signal before transmission to the receiving television or monitor. Generally, this is the case when the VCR receives its input signal from an antenna. When a video amplifier is necessary, the video amplifier (not shown) is interposed between the VHF output terminal 18*b* of the VCR and the home telephone system modular telephone jack, using the appropriate adater 30 or 30'' and connector cables 70. If the video amplifier has multiple output terminals, it can also be used simultaneously to connect the VCR to a television or a computer monitor in the same room as the VCR.

Thus, it will be seen that all embodiments of the present invention provide unique apparatus for connecting a VCR to other video equipment. Moreover, the installation and operation of the apparatus is both effective and easy to accomplish, so as to render use of all embodiments convenient to users. While preferred embodiments of the invention have been disclosed, it should be understood that the spirit and scope of the invention are to be limited solely by the appended claims, since numerous modifications of the disclosed embodiments will undoubtedly occur to those of skill in the art.

I claim:

1. Apparatus for connecting the VHF output terminal of a video cassette recorder to a 75 ohm input terminal of video equipment, comprising:

first and second modular adapters, each said adapter comprising:

an insulating housing comprising a modular jack portion having a modular jack-receiving opening extending therein and a coaxial connector portion having a coaxial connector-receiving opening extending therein;

a standard six-position modular telephone jack positioned in said modular jack-receiving opening, said jack having at least first and second conductors mounted therein in two of said six positions; and a male coaxial connector positioned in said coaxial connector-receiving opening and comprising a solid central conductor and a conductive wire sheath insulated from said solid central conductor, said solid central conductor being electrically connected to said first conductor of said modular jack and said conductive wire sheath being electrically connected to said second conductor of said modular jack; and a connector cable comprising an insulated cable having first and second ends terminated respectively by first and second standard, six-position modular telephone connectors insertable into said first and second modular jack, said insulated cable having at least first and second insulated conductive wires therein and each of said telephone connectors having only first and second conductive terminals contained therein piercing said first and second wires, respectively, said first and second conductive terminals being positioned in two of said six positions of said telephone connectors corresponding to the positions in which said first and second conductors are mounted in said telephone jack.

2. The apparatus of claim 1, said first and second conductors of said modular jack being positioned in positions two and five of said modular jacks.

3. The apparatus of claim 1, said coaxial connector of both of said adapters being adapted to mate with a 75 OHM VHF input terminal of a television.

4. The apparatus of claim 1, said male coaxial connector of one of said adapters being adapted to mate with the 75 ohm VHF output terminal of a video cassette recorder, and said male coaxial connector of the other of said adapters being adapted to mate with a 75 ohm input terminal of a computer monitor.

5. A modular adapter for connection to the 75 ohm VHF output terminal of a video cassette recorder, comprising:

an insulated housing comprising first and second modular jack portions having first and second modular jack-receiving openings, respectively, extending therein,acoaxial connector portion having a coaxial connector-receiving opening extending therein, and a switch portion having a switch-receiving opening extending therein;

first and second standard, six-position modular telephone jacks positioned respectively in said first and second modular jack-receiving openings, each of said modular jacks having first and second conductors mounted therein in two of said six positions;

a male RF coaxial connector positioned in said coaxial connector-receiving opening and including a solid central conductor and a conductive wire sheath insulated from said solid central conductor; and switch means movable between a first and second position for selectively connecting said coaxial connector to one of said first and second modular jacks, respectively, said switch means having first, second, and third conductive means, said first conductive means being electrically connected to said first and second conductors of said first modular jack, said second conductor means being electrically connected to said first and second conductors of said second modular jack, and said third conductor means being electrically connected to said solid central conductor and said wire conductive sheath of said coaxial connector.

6. The adapter of claim 5, said first and second conductors being positioned in positions two and five of said modular jacks.

* * * * *